US007909935B2

(12) United States Patent
Warren et al.

(10) Patent No.: US 7,909,935 B2
(45) Date of Patent: Mar. 22, 2011

(54) METHOD FOR CLEANING A FLUID DELIVERY SYSTEM

(75) Inventors: Jonathan N. Warren, Dearborn, MI (US); Phillip J. Beauchamp, Warren, MI (US); Finn Bergishagen, West Bloomfield, WI (US); Denise A. Palumbo, Dearborn, MI (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 12/249,161

(22) Filed: Oct. 10, 2008

(65) Prior Publication Data

US 2009/0101171 A1 Apr. 23, 2009

Related U.S. Application Data

(60) Provisional application No. 60/980,928, filed on Oct. 18, 2007.

(51) Int. Cl.
*B08B 9/00* (2006.01)

(52) U.S. Cl. ..... 134/7; 134/6; 134/8; 134/22.1; 134/22.11; 134/22.12; 134/22.14; 134/22.18; 134/22.19; 134/26; 134/27; 134/28; 134/29; 134/34; 134/36; 134/40; 134/41; 134/42

(58) Field of Classification Search ..... 134/6, 7, 134/8, 22.1, 22.11, 22.12, 22.14, 22.18, 22.19, 134/26, 27, 28, 29, 34, 36, 40, 41, 42
See application file for complete search history.

(56) References Cited

U.S. PATENT DOCUMENTS

| | | | | |
|---|---|---|---|---|
| 3,272,650 | A * | 9/1966 | Macvittie | 134/7 |
| 4,818,298 | A * | 4/1989 | Shishkin et al. | 134/22.11 |
| 4,947,591 | A * | 8/1990 | Risley | 451/39 |
| 4,968,447 | A * | 11/1990 | Dixon et al. | 510/202 |
| 5,443,748 | A * | 8/1995 | Bergishagen et al. | 510/201 |
| 5,536,439 | A * | 7/1996 | Harbin | 510/212 |
| 5,616,183 | A * | 4/1997 | Dieter et al. | 134/8 |
| 5,993,562 | A * | 11/1999 | Roelofs et al. | 134/7 |
| 2003/0102011 | A1 * | 6/2003 | Smith et al. | 134/8 |
| 2003/0158062 | A1 * | 8/2003 | Wilson | 510/201 |
| 2005/0009718 | A1 * | 1/2005 | Wilson et al. | 510/201 |
| 2005/0137104 | A1 | 6/2005 | Maxwell et al. | |
| 2009/0101171 | A1 * | 4/2009 | Warren et al. | 134/7 |

FOREIGN PATENT DOCUMENTS

| | | | |
|---|---|---|---|
| EP | 1 304 189 | A | 4/2003 |
| WO | WO 97/04889 | A | 2/1997 |
| WO | WO 98/06802 | A | 2/1998 |

* cited by examiner

*Primary Examiner* — Sharidan Carrillo
(74) *Attorney, Agent, or Firm* — Steven W. Hays

(57) ABSTRACT

The present invention is directed to a method of cleaning an interior surface of a fluid delivery system. The method comprises introducing a first liquid into the fluid delivery system and contacting the interior surface with the first liquid; forming a slurry by introducing a particulate into the first liquid and contacting the interior surface with the slurry; introducing a second liquid into the fluid delivery system and contacting the interior surface with the second liquid; and introducing a third liquid into the fluid delivery system and contacting the interior surface with the third liquid. The first liquid is substantially soluble or substantially insoluble in the second liquid, the second liquid is substantially insoluble in the third liquid, and the particulate is substantially insoluble in the first and second liquids and substantially soluble in the third liquid.

21 Claims, 2 Drawing Sheets

METHOD FOR CLEANING A FLUID DELIVERY SYSTEM

BACKGROUND OF THE INVENTION

1. Field of the Invention

The present invention relates to a method of cleaning an interior surface of a fluid delivery system.

2. Background Information

Large quantities of fluids with suspended, dispersed and/or dissolved materials are circulated through fluid delivery systems. Over time, these materials may deposit or settle on various interior surfaces of the fluid delivery system. For example, paint is circulated and usually recirculated in piping of paint delivery systems for painting automobiles in automobile manufacturing plants. During the course of normal operation, the materials contained within the paint may build up or deposit on the interior surface of the paint fluid delivery systems. This is especially true in areas of reduced flow such as in filters, tees, elbows, valves, microfiltration and/or ultrafiltration tubes. As a consequence, fluid delivery systems, such as those used in the automotive industry, are cleaned on a periodic basis to remove the unwanted materials which have deposited onto the interior surface of the fluid delivery system.

Conventional fluid circulation & delivery system cleaning materials primarily incorporate the use of liquid blends to solubilize, dissolve, and remove unwanted deposits of materials. While this practice has proven sufficient in many cases, in some instances, it has not been entirely effective in returning the piping and related components to the cleanliness of their original build condition. This shortcoming was addressed by incorporating an abrasive media particulate into the cleaning solution which, when compared to the various liquid blends discussed above, cleaned the piping and related equipment of a fluid delivery system more thoroughly.

One obstacle, however, with cleaning a paint fluid delivery system with such an abrasive material is the complete removal of the abrasive media material after the cleaning process is complete. Accordingly, there is a need for a method of cleaning an interior surface of a fluid delivery system such that the cleaning materials are removed from the fluid delivery system after the interior surface of the fluid delivery system has been cleaned.

SUMMARY OF THE INVENTION

The present invention is directed to a method of cleaning an interior surface of a fluid delivery system. The method comprises introducing a first liquid into the fluid delivery system and contacting the interior surface with the first liquid; forming a slurry by introducing a particulate into the first liquid and contacting the interior surface with the slurry; introducing a second liquid into the fluid delivery system and contacting the interior surface with the second liquid; and introducing a third liquid into the fluid delivery system and contacting the interior surface with the third liquid.

In some embodiments, the first liquid is substantially soluble in the second liquid, the second liquid is substantially insoluble in the third liquid, and the particulate is substantially insoluble in the first and second liquids while being substantially soluble in the third liquid.

In other embodiments, the first liquid is substantially insoluble in the second liquid, the second liquid is substantially insoluble in the third liquid, and the particulate is substantially insoluble in the first and second liquids while being substantially soluble in the third liquid.

BRIEF DESCRIPTION OF THE DRAWINGS

A full understanding of the invention can be gained from the following description of certain embodiments of the invention when read in conjunction with the accompanying drawings in which.

DETAILED DESCRIPTION OF THE INVENTION

Figure 1:
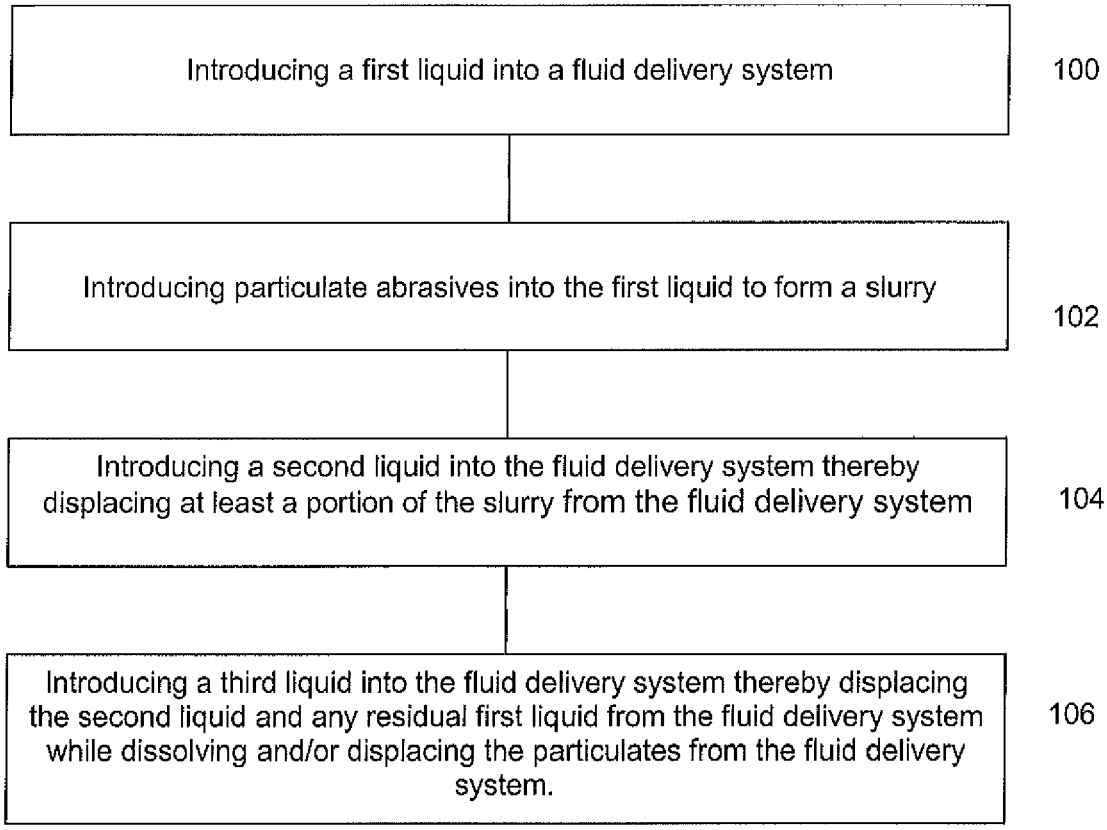
FIG. 1 is a flowchart depicting an embodiment of the disclosed invention.

As used herein, unless otherwise expressly specified, all numbers such as those expressing values, ranges, amounts or percentages may be read as if prefaced by the word "about", even if the term does not expressly appear. Plural encompasses singular and vice versa. For example, "a" first fluid, "a" particulate, "a" second fluid, "a" third liquid, and any other component refers to one or more of these components.

As employed herein, the term "number" means one or an integer greater than one (i.e., a plurality).

As used herein, "substantially soluble" will refer to the solubility of a liquid or particulate in another liquid as being $\geqq 15$ g/L at 20° C.

As used herein, "substantially insoluble" will refer to the solubility of a liquid or particulate in another liquid as being $\leqq 10$ g/L at 20° C.

The present invention is directed to a method of cleaning an interior surface of a fluid delivery system on which a material, such as paint, has been deposited onto all or some of the interior surface of the fluid delivery system. Use of the phrase "interior surface" refers not only to the actual interior surface of the fluid delivery system, but the phrase also refers to an interior surface of the fluid delivery system onto which a material has been deposited onto all or some of the interior surface of the fluid delivery system.

Specifically, the present invention involves introducing a series of liquids as well as particulates into the fluid delivery system and allowing the liquids and/or the particulate to contact the interior surface of the fluid delivery system thereby cleaning the interior surface of the fluid delivery system such that any material that has been deposited on the interior surface of the fluid delivery system is removed. It will be understood that the material that is deposited on the interior surface of the fluid delivery system can be removed by a variety of mechanisms including, but not limited to, dissolution, abrasion, loss of adhesion to the interior surface of the fluid delivery system due to the flow of the liquids and/or particulate through the fluid delivery system, and/or combinations thereof.

In certain embodiments, the process disclosed in the present invention begins with the introduction of a first liquid into the fluid delivery system by means that are known in the art. For example, a pump may be used to transport the first liquid from a holding tank, which is in communication with the fluid delivery system, to the fluid delivery system. In some embodiments, the first liquid can comprise, without limitation, water (e.g., deionized water, tap water), ethylene based glycol ethers and diethers, propylene based glycol ethers and diethers, n-Methyl-2-Pyrrolidone, single-protic alcohols, diprotic alcohols, tri-protic alcohols, benzyl alcohol, amines, hydroxide compounds, or combinations thereof.

Suitable glycol ethers that may be used in the first liquid include, without limitation, ethylene glycol monobutyl ether, diethylene glycol monobutyl ether, propylene glycol methyl ether, dipropylene glycol dimethyl ether, or combinations thereof.

Suitable alcohols that may be utilized in the first liquid include, without limitation, methanol, isopropanol, n-butanol, or combinations thereof.

Suitable amines that may be used in the first liquid include, without limitation, dimethanolamine, monoethanolamine, amino methanol propanol, or combinations thereof.

Suitable hydroxide compounds that may be utilized in the first liquid include, without limitation, potassium hydroxide, sodium hydroxide, or combinations thereof.

In some embodiments, the first liquid is either a solvent or swellant for the material that is deposited on the interior surface of the fluid delivery system. In other words, the first liquid can facilitate the removal of the material that is deposited on the interior surface of the fluid delivery system. Once the first liquid is introduced into the fluid delivery system, at least some of the first liquid contacts the interior surface of the fluid delivery system. In certain embodiments, the first liquid is circulated through the fluid delivery system for 12 to 120 hours. As will be discussed in greater detail below, in some embodiments, the first liquid is substantially soluble in a second liquid. In other embodiments, however, the first liquid is substantially insoluble in the second liquid.

After the first liquid is introduced into the fluid delivery system, a particulate abrasive (hereinafter, referred to as particulate(s)), which facilitates the removal of at least a portion of the material that is deposited on the interior surface of the fluid delivery system, is introduced into at least a portion of the first liquid in order to form a slurry. It should be noted that the particulates are introduced into the first liquid by means that are known in the art. Moreover, it will be understood that the slurry is formed due to the fact that the particulates are substantially insoluble in the first liquid. In certain embodiments, the slurry is formed prior to introduction of the slurry into the fluid delivery system.

Once formed, at least some of the slurry contacts the interior surface of the fluid delivery system. In certain embodiments, the particulates are organic particulates having a size ranging from 100 to 500 microns and which comprise polymers (including copolymers) that are substantially insoluble in the first liquid. For example, in some embodiments, the organic particulates comprise acrylic containing polymers, acrylonitrile-butadiene-styrene compounds, ethylene acrylic acid copolymers, polyolefin containing polymers, or combinations thereof. It should be noted, however, that the organic particulates do not contain polypropylene, polyethylene, polyvinyl chloride, or polytetrafluoroethylene.

Moreover, there are no strict limitations on the size of the particulates utilized in the present invention. The particulate size, however, should be small enough that most of the particulates can be readily suspended in the moving slurry, but also large enough to transfer a useful amount of momentum to the material that is deposited on the interior surface of the fluid delivery system, such as a coating of paint residues, such that at least a portion of the material is removed when the particulates collide with the deposited material.

In some embodiments, the material is not only removed via the collision between the material and the particulates, but the material is also removed through dissolution of the material in the first liquid. In certain embodiments, the slurry is circulated through the fluid delivery system for 12 to 120 hours.

In certain embodiments, the slurry flows through the fluid delivery system at a flow rate of ≧20 gallons/minute. For example, in some embodiments, the flow rate of the slurry through the fluid delivery system can range from 20 gallons/minute to 25 gallons/minute. It should be noted, that in certain embodiments, the flow rate of the other fluids that are introduced into the fluid delivery system (e.g., first liquid, second liquid, third liquid, pretreatment fluid discussed below) can either be higher and/or lower than the flow rate of the slurry.

A second liquid is then introduced into the fluid delivery system via means that are known in the art. Because the first liquid is substantially soluble in the second liquid, introduction of the second liquid into the fluid delivery system causes a portion of the first liquid, which comes into contact with the second liquid, to dissolve and/or at least be displaced by the flow of the second liquid through the fluid delivery system. If, however, the first liquid is substantially insoluble in the second liquid, then the second liquid will displace the first liquid from the fluid delivery system. Moreover, because the particulates are substantially insoluble in the second liquid, the flow of the second liquid through the fluid delivery system will displace at least some of the particulates from the fluid delivery system. In other words, the second liquid displaces at least a portion of the slurry from the fluid delivery system while, in some embodiments, the second liquid can also dissolve at least a portion of the slurry as well. In certain embodiments, the second liquid comprises, without limitation, deionized water, alcohols, or combinations thereof. In some embodiment, the second liquid is circulated through the fluid delivery system for 12 to 24 hours in order to purge the fluid delivery system of all or some of the slurry, first liquid, and/or particulates. For purposes of this discussion, it will be understood that in certain embodiments at least a portion of the displaced liquids and/or particulates will be collected in a collection tank that is in communication with the fluid delivery system. It should be noted that the second liquid is substantially insoluble in a third liquid which is introduced into the fluid delivery system after the second liquid.

The third liquid is introduced into the fluid delivery system by means that are known in the art. It will be understood that introduction of the third liquid into the fluid delivery system will displace at least some of the second liquid from the fluid delivery system. In certain embodiments, the third liquid comprises, without limitation, aromatic or aliphatic hydrocarbons, ketones, alcohols, esters, or combinations thereof. As stated above, the particulates in the slurry are substantially soluble in the third liquid. Accordingly, introduction of the third liquid into the fluid delivery system causes the particulates, which come into contact with the third liquid, to dissolve and/or at least be displaced by the flow of the third liquid through the fluid delivery system. Moreover, since the second and first liquids are substantially insoluble in the third liquid, the flow of the third liquid through the fluid delivery system will displace the second and/or first liquids from the fluid delivery system.

In other embodiments, a pretreatment fluid, which can be soluble or insoluble in the first liquid, is introduced into the fluid delivery system prior to introduction of the first liquid. The pretreatment fluid can comprise, without limitation, aromatic or aliphatic hydrocarbons, ketones, alcohols, esters, glycol ethers and diethers, n-Methyl-2-Pyrrolidione, or combinations thereof. In certain embodiments, the pretreatment fluid is a solvent or swellant for the material that is deposited over the interior surface of the fluid delivery system. The pretreatment fluid is substantially soluble in the first liquid. Therefore, introduction of the first liquid into the fluid delivery system causes the pretreatment fluid, which comes into contact with the pretreatment fluid, to dissolve and/or at least be displaced by the flow of the first liquid through the fluid delivery system. In other embodiments, however, the pretreatment fluid is substantially insoluble in the first liquid. Accordingly, introduction of the first liquid into the fluid delivery system will displace the pretreatment fluid from the fluid delivery system.

Referring to FIG. 1, as can be seen for this figure, the first liquid is introduced into the fluid delivery system at step 100. A slurry is formed by introducing particulate abrasives into the first liquid at step 102. A second liquid is then introduced into the fluid delivery system thereby displacing at least a portion of the slurry from the fluid delivery system at step 104. A third liquid is introduced into the fluid delivery system thereby displacing the second liquid and any residual first liquid from the fluid delivery system while dissolving and/or displacing the particulates from the fluid delivery system at step 106.

Figure 2:
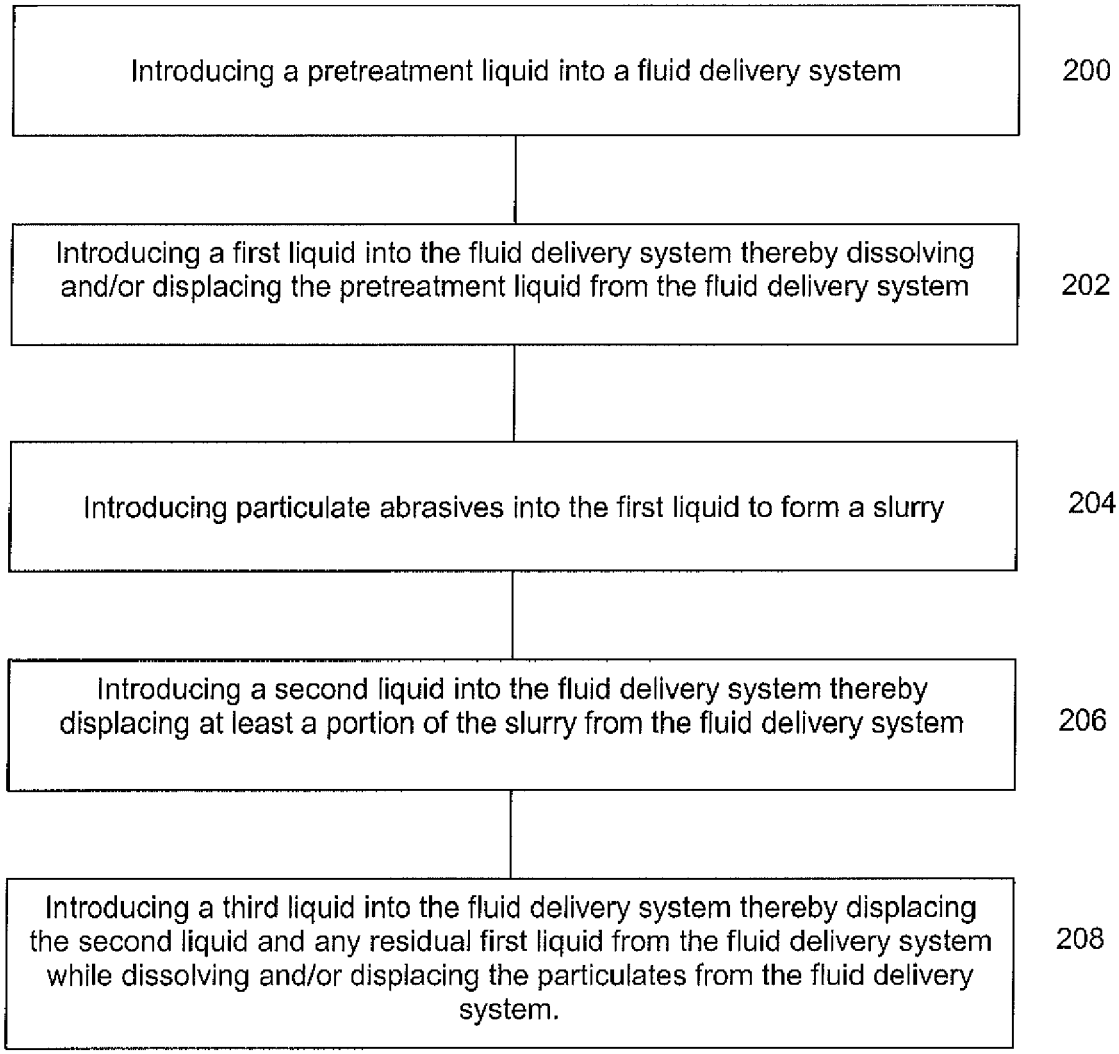
FIG. 2 is a flowchart depicting another embodiment of the disclosed invention.

Referring to FIG. 2, as can be seen from this figure, a pretreatment liquid is introduced into the fluid delivery system at step 200. A first liquid is then introduced into the fluid delivery system thereby dissolving and/or displacing the pretreatment liquid from the fluid delivery system at step 202. A slurry is then formed by introducing particulate abrasives into the first liquid at step 204. A second liquid is then introduced into the fluid delivery system thereby displacing at least a portion of the slurry from the fluid delivery system at step 206. A third liquid is introduced into the fluid delivery system thereby displacing the second liquid and any residual first liquid from the fluid delivery system while dissolving and/or displacing the particulates from the fluid delivery system at step 208.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A method of cleaning an interior surface of a fluid delivery system comprising:

introducing a first liquid into said fluid delivery system and contacting said interior surface with said first liquid;

forming a slurry by introducing a particulate into said first liquid and contacting said interior surface with said slurry wherein the particulate comprises acrylonitrile-butadiene-styrene;

introducing a second liquid into said fluid delivery system and contacting said interior surface with said second liquid; and introducing a third liquid into said fluid delivery system and contacting said interior surface with said third liquid;

wherein said first liquid is substantially soluble in said second liquid, each of said first and second liquids is substantially insoluble in said third liquid, and said particulate is substantially insoluble in said first and second liquids and substantially soluble in said third liquid.

2. The method according to claim 1, further comprising introducing a pretreatment fluid into said fluid delivery system and contacting said interior surface with said pretreatment fluid prior to introducing said first liquid into said fluid delivery system, said pretreatment fluid being substantially soluble in said first liquid.

3. The method according to claim 1, further comprising displacing at least a portion of said slurry with said second liquid, and displacing said second liquid with said third liquid.

4. The method according to claim 1, wherein each of the first, second, and third liquids are chemically distinct from one another.

5. The method according to claim 1, wherein the first liquid comprises water, ethylene based glycol ethers and diethers, propylene based glycol ethers and diethers, n-Methyl -2-Pyrrolidone, single-protic alcohols, di-protic alcohols, tri-protic alcohols, benzyl alcohol, amines, and hydroxide compounds, or combinations thereof.

6. The method according to claim 1, wherein said second liquid comprises deionized water, alcohols, or combinations thereof.

7. The method according to claim 1, wherein said third liquid comprises aromatic hydrocarbons, aliphatic hydrocarbons, ketones, alcohols, esters, or combinations thereof.

8. The method according to claim 2, wherein the pretreatment fluid comprises aromatic or aliphatic hydrocarbons, a ketone, an alcohol, an ester, glycol ethers and diethers, n-Methyl-2-Pyrrolidione, or combinations thereof.

9. The method according to claim 2, further comprising dissolving at least a portion of said pretreatment fluid with said first liquid.

10. A method of cleaning an interior surface of a fluid delivery system comprising:

introducing a first liquid into said fluid delivery system and contacting said interior surface with said first liquid;

forming a slurry by introducing a particulate into said first liquid and contacting said interior surface with said slurry; and wherein the particulate comprises acrylonitrile-butadiene-styrene;

introducing a second liquid into said fluid delivery system and contacting said interior surface with said second liquid; and introducing a third liquid into said fluid delivery system and contacting said interior surface with said third liquid;

wherein said first liquid is substantially insoluble in said second liquid, each of said first and second liquids is substantially insoluble in said third liquid, and said particulate is substantially insoluble in said first and second liquids and substantially soluble in said third liquid.

11. The method according to claim 10, further comprising introducing a pretreatment fluid into said fluid delivery system and contacting and contacting said interior surface with said pretreatment fluid prior to introducing said first liquid into said fluid delivery system, said pretreatment fluid being substantially soluble in said first liquid.

12. The method according to claim 10, further comprising displacing at least a portion of said slurry with said second liquid, and displacing said second liquid with said third liquid.

13. The method according to claim 10, wherein each of the first, second, and third liquids are chemically distinct from one another.

14. The method according to claim 10, wherein the first liquid comprises water, ethylene based glycol ethers and diethers, propylene based glycol ethers and diethers, n-Methyl -2-Pyrrolidone, single-protic alcohols, di-protic alcohols, tri-protic alcohols, benzyl alcohol, amines, and hydroxide compounds, or combinations thereof.

15. The method according to claim 10, wherein said second liquid comprises deionized water, alcohols, or combinations thereof.

16. The method according to claim 10, wherein said third liquid comprises aromatic hydrocarbons, aliphatic hydrocarbons, ketones, alcohols, esters, or combinations thereof.

17. The method according to claim 11, wherein said pretreatment fluid comprises an aromatic hydrocarbon, an aliphatic hydrocarbon, a ketone, an ester, an alcohol, or combinations thereof.

18. A method of cleaning an interior surface of a fluid delivery system comprising:

introducing a first liquid into said fluid delivery system and contacting said interior surface with said first liquid;

introducing a slurry into said fluid delivery system and contacting said interior surface with said slurry, said slurry comprising a particulate and said first liquid; and wherein the particulate comprises acrylonitrile-butadiene-styrene;

introducing a second liquid into said fluid delivery system and contacting said interior surface with said second liquid; and introducing a third liquid into said fluid delivery system and contacting said interior surface with said third liquid;

wherein said first liquid is substantially soluble or insoluble in said second liquid, each of said first and second liquids is substantially insoluble in said third liquid, and said particulate is substantially insoluble in said first and second liquids and substantially soluble in said third liquid.

19. The method according to claim 18, further comprising introducing a pretreatment fluid into said fluid delivery system and contacting and contacting said interior surface with said pretreatment fluid prior to introducing said first liquid into said fluid delivery system, said pretreatment fluid being substantially soluble in said first liquid.

20. The method according to claim 19, wherein each of the first, second, and third liquids are chemically distinct from one another.

21. The method according to claim 19, wherein said pretreatment fluid comprises an aromatic hydrocarbon, an aliphatic hydrocarbon, a ketone, an ester, an alcohol, or combinations thereof.

* * * * *